United States Patent [19]

Mück et al.

[11] Patent Number: 4,689,840

[45] Date of Patent: Sep. 1, 1987

[54] BUILT-IN SINK

[75] Inventors: Manfred Mück, Kürnbach; Walter Blanc, Oberderdingen; Hans-Albert Müller, Schwabach, all of Fed. Rep. of Germany

[73] Assignee: Blanc GmbH & Company, Fed. Rep. of Germany

[21] Appl. No.: 874,694

[22] Filed: Jun. 16, 1986

Related U.S. Application Data

[63] Continuation of Ser. No. 711,958, Mar. 14, 1985, abandoned.

[30] Foreign Application Priority Data

Mar. 20, 1984 [DE] Fed. Rep. of Germany ..... 3410103
Jan. 17, 1985 [DE] Fed. Rep. of Germany ..... 3501443

[51] Int. Cl.[4] ..... E03C 1/00

[52] U.S. Cl. ..... 4/629; 4/661; 4/DIG. 4

[58] Field of Search ..... 4/629, DIG. 4, 639, 4/625, 661

[56] References Cited

U.S. PATENT DOCUMENTS

| | | | |
|---|---|---|---|
| 1,574,273 | 2/1926 | Allen . | |
| 1,635,361 | 7/1927 | Fuson | 4/629 |
| 1,830,781 | 11/1931 | Brotz | 4/629 X |
| 2,474,101 | 6/1949 | Frothingham et al. . | |
| 2,498,502 | 2/1950 | O'Brien | 4/629 |
| 3,528,718 | 9/1970 | Johnson et al. . | |
| 3,559,208 | 2/1971 | Hopkins | 4/629 |
| 3,874,016 | 4/1975 | Ritter | 4/629 |

*Primary Examiner*—Henry K. Artis
*Attorney, Agent, or Firm*—Leydig, Voit & Mayer

[57] ABSTRACT

Built-in sink with a waste opening which is adjoined downwardly by a drop shaft terminating above a waste bin. The latter is guided in horizontal guide rails supported by a holding device which is attached to the underside of the built-in sink and also supports the drop shaft. In order to eliminate cleaning of the latter, there is inserted into the waste opening from above a removable protective shaft which is closable by a removable cover.

32 Claims, 5 Drawing Figures

20
22a
22
B
36
28
A
10
34
34a
50
48
52
14
54
64
68
66
80
58
74
90
72
42
24
82
86
26
84
78

BUILT-IN SINK

This application is a continuation of application Ser. No. 711,958, filed Mar. 14, 1985 and now abandoned.

The invention relates to a built-in sink comprising a waste opening and also a holding device arranged beneath the built-in sink and held by it for a waste container which may be fitted beneath the waste opening. In particular, the invention deals with such built-in sinks as are made of high-quality sheet steel, enameled sheet steel or a plastic material.

The built-in kitchen unit accommodating the conventional built-in sinks in the cover plate of a built-in kitchen unit has at least one door in front of the built-in sink, with a waste bin removably attached to it. In this case, kitchen waste occurring in the area of the built-in sink is removed by the aforementioned door being swivelled open, making the waste bin accessible, whereupon the waste is thrown into this bin. During this procedure, it is impossible to prevent liquids, in particular, dirty dripping water, from soiling those areas over which the waste must be conveyed, i.e., not only the built-in sink itself, but also the cover plate of the built-in kitchen unit and possibly also the floor in front of it.

Various attempts have, therefore, been made to resolve the problem of waste disposal in the area of a sink.

Already known, for example, from German Offenlegungsschrift No. 3 015 952 is a built-in sink of the kind mentioned at the outset, with a movable basin for leftovers located beneath the waste opening so as to be lowered by a relatively complicated mechanism and then swivelled about a horizontal axis through 180° so that the waste in the basin for leftovers falls into a waste bin arranged beneath the waste opening. Two horizontal guide rails whose cross-section corresponds to a lying U and which are supported by a holding device attached to the underside of the built-in sink are provided for this waste bin.

The object underlying the invention is to create a construction which is of simpler design than the known, above-described construction, and which provides a more satisfactory solution to the waste disposal problem.

Departing from a built-in sink of the kind mentioned at the outset, this object is attained in accordance with the invention in that there is attached to the built-in sink a drop shaft or chute, which extends downwardly from the underside of the sink and encompasses the waste opening. The invention therefore provides a unit of quite simple design consisting substantially of the built-in sink, a drop shaft and a holding device for a waste container. This unit may be pre-assembled by the workman installing a built-in sink, so that the workman installing a built-in kitchen need only insert it into the cut-out section of a cover plate of a built-in kitchen unit. The kitchen waste occurring in the area of the built-in sink is simply thrown into the waste opening, with the drop shaft ensuring that the waste falls solely into the waste container. Complicated actuating mechanisms such as those required for the basin for leftovers in the known above-described construction, necessitating actuation by the housewife, may be eliminated. It is expedient to close the waste opening by a simple cover which, however, need only be raised or swivelled upwards.

In order to ensure that liquids, in particular, dripping water, occurring on the upper side of the built-in sink are prevented from reaching the built-in kitchen unit via the waste opening, the built-in sink is provided in a preferred embodiment according to the invention with a collar which protrudes downwardly into the drop shaft and whose external cross-section is adapted to the internal cross-section of the drop shaft so that the collar fits into the drop shaft. It is thus ensured that liquids reaching the area of the waste opening may only run down the inside of the drop shaft and therefore drop into the waste container.

The construction is particularly easy to manufacture if the upper end of the drop shaft simply rests against the underside of the sink.

In order to eliminate the necessity of cleaning the drop shaft and dismantling it for this purpose, provision of a protective shaft or chute, which may be inserted into the drop shaft and lifted out of the sink in an upward direction is recommended. This protective shaft prevents soiling of the walls of the drop shaft. In order to hold the protective shaft in its functional position, in a simple manner, a preferred embodiment of the built-in sink according to the invention comprises an attachment edge which circumscribes the waste opening and onto which the protective shaft may be attached by an upper flange. To prevent liquids occurring on the upper side of the built-in sink from reaching the area between the protective shaft and the drop shaft, provision of a sealing member between the upper end of the protective shaft and the sink is recommended. This is preferably fitted at the flange of the protective shaft so as to rest against the attachment edge circumscribing the waste opening when the protective shaft is inserted into the drop shaft. The aforementioned cover may itself by provided with a sealing member, but if a sealing member is already provided at the upper end of the protective shaft, it is particularly advantageous to also provide at the upper end of the protective shaft a sealing member which cooperates with the cover and is expediently integral with the sealing member which may be made to abut against the attachment edge.

If a waste container which may be pulled out of the built-in kitchen unit in a forward direction is provided, neither the drop shaft nor the protective shaft is allowed to extend into the waste container. In such a case, the construction according to the invention is of such design that when the protective shaft is inserted into the sink, its lower edge is flush with that of the drop shaft.

A particularly advantageous embodiment of the built-in sink according to the invention is characterized by the fact that the waste container is in the shape of a bin which with lateral support members may be pushed into guide rails formed by the holding device and extending transversely to the longitudinal direction of the sink and also at least approximately horizontally, and that the upper opening of the bin held beneath the lower end of the drop shaft is larger than the cross-section of the drop shaft. This results in a number of substantial advantages: the waste container may be easily fitted beneath the waste opening and removed from the built-in kitchen unit; a waste container with quite a substantial volume may be arranged beneath the built-in sink although the waste opening and the cross-section of the drop shaft are relatively small; even if the housewife throws so much waste into the waste opening that it piles up in the drop shaft or protective shaft, the natural angle of repose forming in the waste container ensures that there remains laterally in the waste container a free space into which the waste located in the drop shaft or protective shaft may fall when the waste container is pulled out from beneath the built-in sink so that on pulling out the waste container, waste is definitely prevented from falling into the built-in kitchen unit. In order to ensure optimal use of the waste container volume, it is recommended for the construction to be of such design that when the bin is in its inserted end position, the drop shaft is located above the front bin area, so that on pulling out the bin, the bin volume kept free by the natural angle of repose glides past beneath the drop shaft. It is furthermore advantageous to provide a closure plate to cover the opening area of the bin located in its inserted end position which protrudes rearwardly beyond the drop shaft. In order to keep the work of the workman installing the sink to a minimum, it is, furthermore, recommended to design the construction such that the closure plate is rigidly connected to the sink. Provision of a supporting device attached to the sink for the guide rails serves the same purpose.

The drop shaft could, for example, be welded to the underside of the sink, or in the case of a plastic sink, molded to it. The guide rails could be laterally staggered in relation to the edges of the waste opening and/or extend at an incline to the horizontal. "Longitudinal direction of the sink" is the direction extending approximately parallel to the front edge of the sink, i.e., the one facing the housewife, or of a table or work plate accommodating it. It is also conceivable for the drop shaft to comprise in its front wall at the bottom a cut-out section into which the waste container is pushed from the front. Special designs are not required for the waste container since a conventional waste bin with an outwardly bent upper edge may be used. Waste bins made of plastic, which are available on the market in almost any desired shape, are particularly advantageous.

Particularly in the case of built-in sinks made of high-quality sheet steel, it is recommendable to attach the supporting device near to the front and the rear edge of the built-in sink on its underside so that the supporting forces in the edge area of the built-in sink are introduced into it and do not cause a deformation, for example, in a work or draining surface of the built-in sink beside the sink.

A particularly simple unit which may be pre-assembled by the manufacturer of the built-in sink is obtained if the drop shaft is held by the supporting device and positioned against the underside of the sink. The drop shaft itself may be a component of the supporting device, more particularly, by its upper area being attached with the aid of an attachment member in the area of the front edge of the built-in sink on its underside, and by it supporting indirectly or directly with its lower area the front areas of the guide rails. In an embodiment with the aforementioned closure plate, a construction which is particularly easy to manufacture is obtained if the guide rails are formed on the closure plate, or, which is less advantageous, attached to it. The front area of the closure plate may then be supported by the drop shaft.

Modern built-in kitchens have a modular system which stipulates, for example, for a base cupboard a width of 60 cm. In a preferred embodiment of the built-in sink according to the invention, the waste opening is arranged directly beside the sink, and the distance between the side of the waste opening facing away from the sink and the side of the sink facing away from the waste opening corresponds to the width of the modular system referred to hereinabove, i.e., more particularly, approximately 60 cm. The space beneath the sink and also the waste container associated with the drop shaft are then made accessible by swivelling open a door of a base cupboard, with space for a further waste container or the like remaining beneath the sink. This is particularly advantageous if, as is the current trend, the kitchen waste is to be split up into organic and inorganic material, so that organic waste such as, for example, vegetable leftovers can be thrown into the waste container associated with the drop shaft via the waste opening, while bottles, metal and the like are deposited in a waste bin which is put into the base cupboard beneath the sink.

As was explained hereinabove, a preferred embodiment of the built-in sink according to the invention provides a waste container which is arranged at a distance beneath the sink surface and extends—in a top view of the built-in sink—beyond the waste opening. In such a case, space remains in front of, but preferably behind the waste opening, and also beside the sink above the waste container, for a basin for leftovers or the like, so that it is recommended to provide beside the sink, behind one another, the waste opening and a trough provided with an outlet opening, and to design the construction such that the opening of the waste bin corresponds in size and configuration approximately to the scope of the built-in sink defined by the waste opening and the trough.

To prevent the occurrence of bad odour above the built-in sink, caused by gases resulting, for example, from a fermenting process in the waste container, the closure plate of a preferred embodiment is located at a distance above the upper edge of the bin so that the aforementioned gases may escape into the built-in kitchen unit space beneath the built-in sink.

As already mentioned, the drop shaft may be attached to the closure plate. In this case, it is advantageous for the closure plate to comprise an opening corresponding to the cross-section of the drop shaft and to be attached to the drop shaft. If the closure plate is then so designed that its front edge area extends upwardly at an incline, the waste bin may also be inserted into the guide rails at an incline from above.

Further features, advantages and details of the invention are apparent from the attached claims and/or the following description and also from the appended drawings of a particularly advantageous embodiment of the sink according to the invention.

Figure 1:
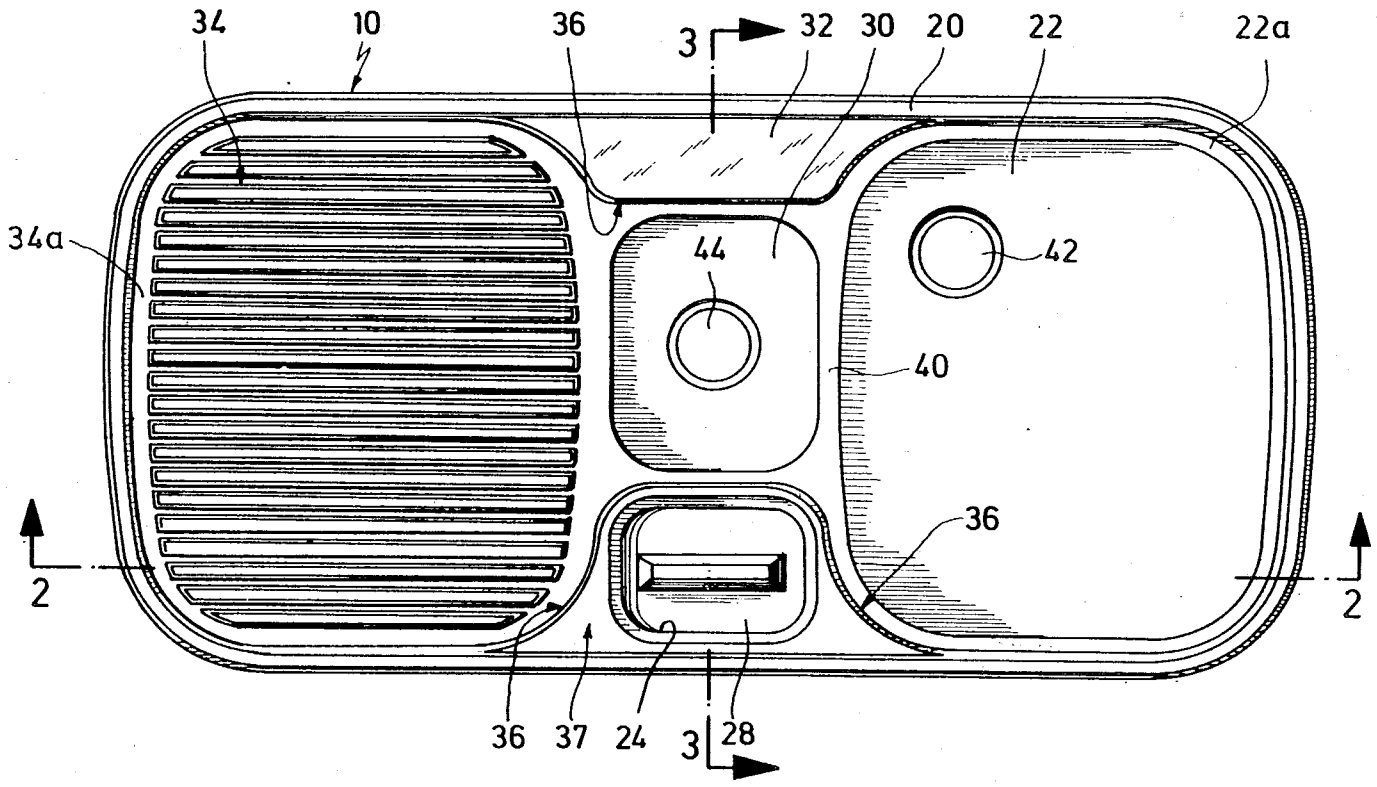
FIG. 1 is a top view of the built-in sink.
Figures 2, 2A, 2B:
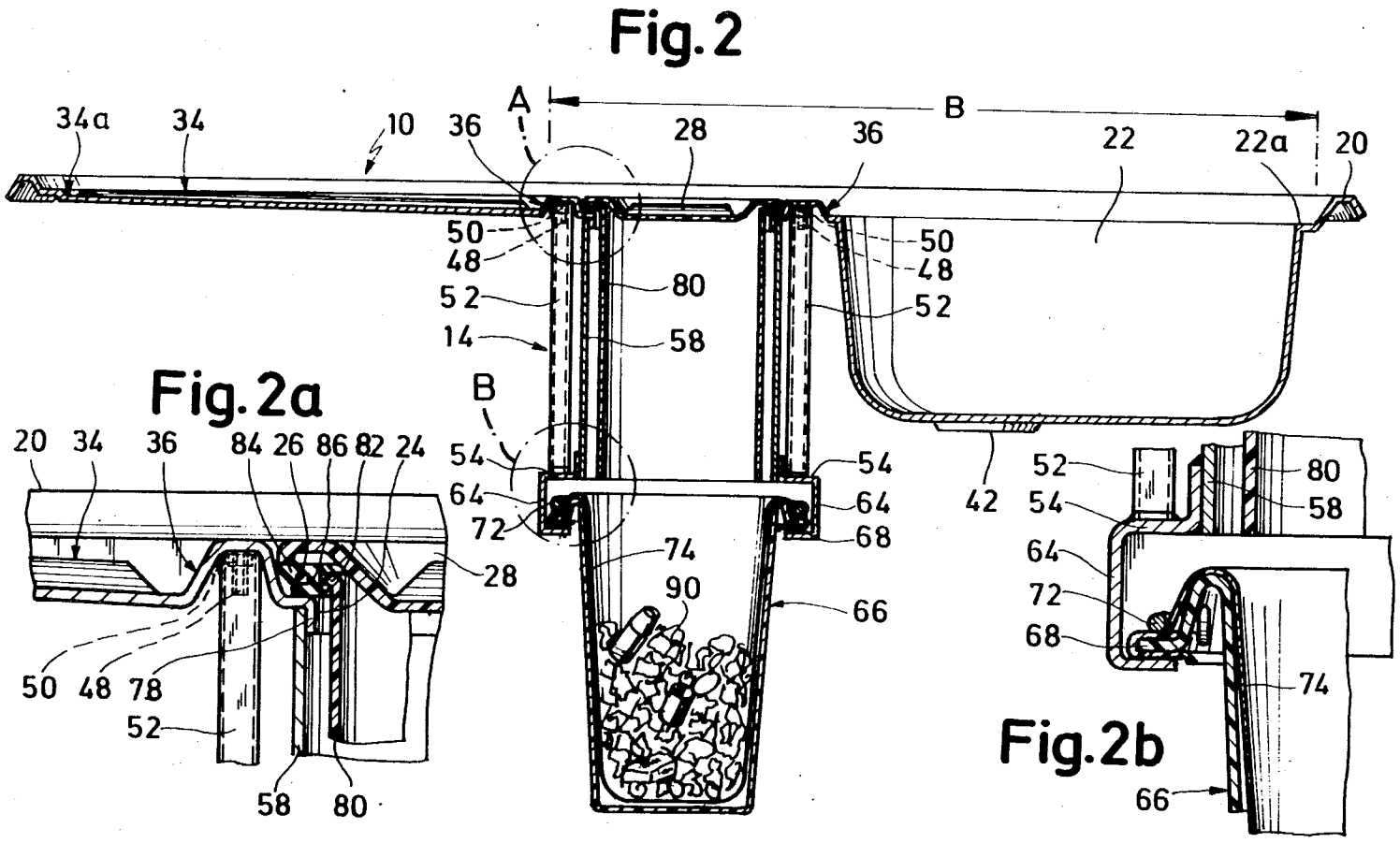
FIG. 2 is a section taken through the built-in sink along line 2—2 in FIG. 1.
Figure 3:
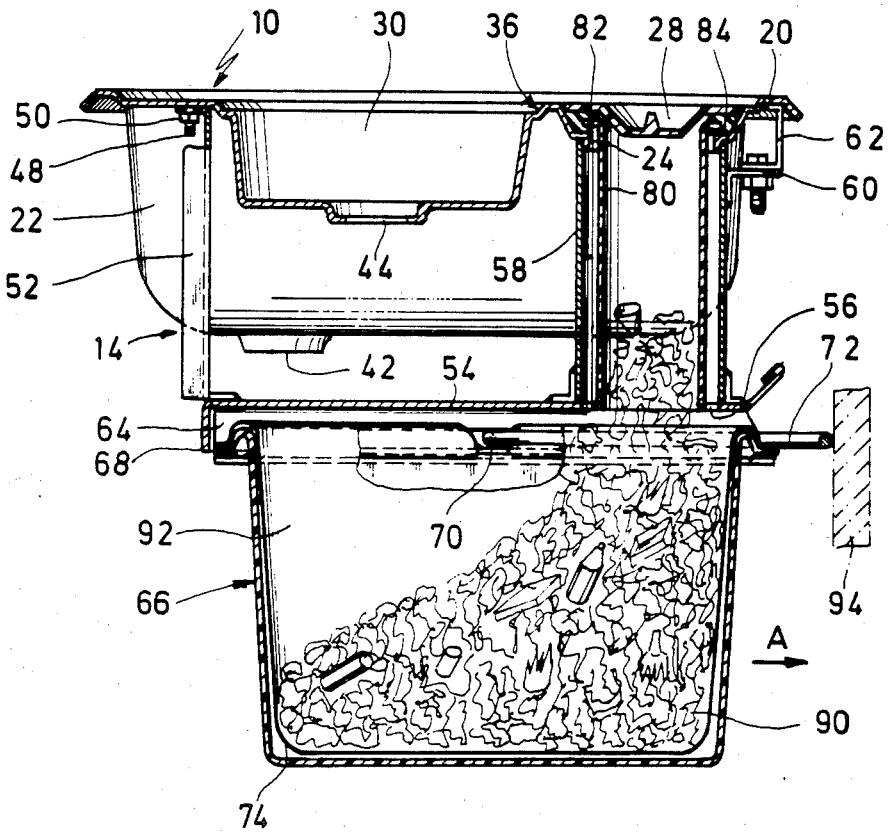

FIG. 2*a* shows the section designated "A" in FIG. 2 on a larger scale than in FIG. 2;

FIG. 2*b* shows the section designated "B" in FIG. 2 on a larger scale than in FIG. 2; and FIG. 3 is a section taken through the built-in sink along line 3—3 in FIG. 1.

The actual built-in sink 10 illustrated in FIG. 1 has a circumferential, raised supporting edge 20, with which it rests on a table or cover plate of a built-in kitchen unit, not illustrated, in the form of a base cupboard. This table plate has a cut-out section which corresponds in shape to the built-in sink 10 and into which the areas of the built-in sink located beneath the supporting edge 20 fit. The supporting edge 20 therefore supports the entire construction according to the invention.

The actual built-in sink 10 includes—viewed from right to left in FIG. 1—a sink 22, beside it, from the front to the rear, behind one another, a waste opening 24 (see, for example, also FIG. 2*a*) with a circumferential, recessed attachment edge 26, onto which a cover 28 is placed, a leftovers trough 30 and a fittings base 32, adjoined towards the left by a draining surface 34 with upwardly protruding ribs. All of these areas are enclosed by the supporting edge 20, and a step 36 forming a closed line surrounds the draining surface 34, the leftovers trough 30 and the sink 22.

In accordance with the invention, the bottom 34*a* of the draining surface 34, an edge area 22*a* surrounding the sink 22, and a surface 40 surrounding the leftovers trough 30 form one single plane which in accordance with FIG. 1 preferably descends from the left to the right in the direction towards the sink 22. Outlet openings of the sink 22 and the leftovers trough 30 were designated by 42 and 44, respectively. The step 36 prevents drips, splashes and gushes of water occurring in the areas of the draining surface 34, the leftovers trough 30 and the sink 22 from entering the waste opening 34.

The parts of the built-in unit according to the invention located beneath the actual built-in sink 10 will now be explained with reference to FIGS. 2, 2*a*, 2*b* and 3. As is particularly clear from FIG. 3, there are secured, more particularly, welded, in the rear area of the built-in sink 10, to its underside, two threaded bolts 48 with the aid of which and nuts 50, two carrier members 52 were secured to the underside of the built-in sink. Welded to these is a closure plate 54 which comprises in its front area an opening 56 which is adjoined upwardly by a drop shaft 58 which is welded to the closure plate 54 or attached to it in some other way. Welded to the front wall of the drop shaft is an angle bracket 60 which is connected by means of one or several screws and nuts to an angle bracket 62 which was welded to the underside of the built-in sink 10, more particularly, in the area of the front part of the supporting edge 20. This results in the advantage that the drop shaft 58 supports the front part of the closure plate 54. The dimensioning of the carrier members 52 and the angle bracket 62 furthermore ensures that the upper end of the drop shaft is firmly pressed against the built-in sink 10 from below.

Formed on the closure plate 54 laterally are two guide rails 64 into which a waste bin 66 is insertable from the front, i.e., from the right according to FIG. 3. Viewed from above, the latter has, in accordance with the invention, an approximately rectangular shape, with its narrow sides facing towards the front and rear, respectively. At least on its two longitudinal sides, it comprises supporting webs 68 which rest on the guide rails 64 when the waste bin is in the inserted position. Hinged at the longitudinal sides of the waste bin 66, in the area of its upper edge at 70, is a swivable bearing bracket 72 which rests on the supporting webs 68 of the waste bin when it is in its swivelled down state. Insertable in the waste bin 66 is a foil bag 74 which is drawn with its upper edge area around the supporting webs 68 and extends around and under them, with the downwardly swivelled bearing bracket 72 furthermore contributing towards stabilization of the upper edge of the foil bag.

Formed on the built-in sink is a collar 78 which is surrounded by the attachment edge 26 and fits optimally into the drop shaft 58 so that liquid reaching the attachment edge 26 is definitely conducted into the drop shaft 58 and therefore drops into the foil bag 74, but is prevented from flowing into the area of the built-in kitchen unit beneath the built-in sink 10.

In accordance with the invention, there is inserted into the drop shaft 58 from above a protective shaft 80 at whose upper edge a circumferential flange 82 is formed. The latter has an injection-molded sealing member designated in its entirety by 84, which, more particularly, consists of soft PVC, with the flange 82 comprising apertures 86 filled with the material of the sealing member 84 for its stabilization. According to the invention, the sealing member 84 serves a double purpose: firstly, it seals between the flange 82 and the attachment edge 26, and, secondly, between the flange 82 and the cover 28. In this connection, it is advantageous for the height and thickness proportions, which are apparent from FIG. 2*a*, to be selected such that the edge of the cover 28 does not protrude beyond the scope 37 of the actual built-in sink 10 which surrounds the attachment edge 26 and is located between the step 36 and the supporting edge 20.

According to a further feature of the invention, the protective shaft 80 ends at the bottom at the level of the closure plate 54 so as not to impede insertion and withdrawal of the waste bin 66 into and out of the guide rails 64. It is also expedient for the waste bin 66 and the guide rails 64 to be of such design that the upper edge of the waste bin is located at a distance beneath the closure plate 54. Finally, the front area of the closure plate 54 is bent upwardly at an incline, as is apparent from FIG. 3, in order to enable insertion of the waste bin 66 into the guide rails 64 at an incline from above.

In accordance with the invention, the front area of the waste bin 66 is located beneath the drop shaft 58, as is apparent from FIG. 3. This produces in the waste bin, behind the waste 90, an empty space 92 into which the part of the waste which is still located in the protective shaft 80 can fall, more particularly, when the waste bin 66 is pulled foward out of the guide rails 64 in the direction of the arrow A (see FIG. 3).

According to the invention, the supporting bracket 62 in its clapped down position (see FIG. 3) protrudes in a forward direction beyond the waste bin 66 to such an extent that the waste bin is definitely pushed into its rear inserted end position when a door 94, indicated in FIG. 3, of the built-in kitchen unit accommodating the built-in sink, is closed. From FIG. 2 it is apparent that the width of the upper opening of the waste bin 66 equals or is slightly larger than the width of the drop shaft 58, so that the waste also falls into the waste bin when the protective shaft 80 is not inserted. It is also evident from FIG. 2 that a further waste container may be accommodated beneath the sink 22 and beside the waste bin 66. Finally, FIG. 3 shows that the space above the waste bin 66 and behind the drop shaft 58 may be used for the leftovers trough 30.

Also indicated in FIG. 2 is the distance "B" which should conform with the so-called modular dimension (60 cm) of built-in kitchens. This modular dimension relates to the width of a so-called base cupboard, and the dimension "B" should correspond to the clear width of such a base cupboard between its side walls, so that the area of the inventive construction including the sink 22 and the holding device for the drop shaft 58 and the waste bin 66, designated in its entirety in FIG. 2 by 14, fits in between the two side walls of such a base cupboard. This dimension "B" depends on the width of the side walls of a base cupboard and is somewhat less than 60 cm; in the preferred embodiment of the built-in sink according to the invention, the dimension "B" is approximately 56 cm.

What is claimed is:

1. A built-in sink unit comprising a built-in sink with a shaped plate within which a sink basin and beside the same a waste disposal opening are provided, said unit having a drop shaft extending downwardly from the shaped plate and encompassing the waste disposal opening and holding means for carrying a waste container beneath said drop shaft, said waste container having an upper opening larger in cross-sectional area than the cross-sectional area of the drop shaft, said upper opening having a front and rear end relative to the position of the built-in sink said holding means comprising guide means mounting the waste container for horizontal sliding movement transversely to the longitudinal direction of the built-in sink along a path of movement extending between a rear and a front end position, relative to the position of the built-in sink in which the waste container is located in front of the built-in sink, whereas in the rear end position of the waste container the drop shaft is located above an area of the upper opening of the waste container being spaced from the rear end of said upper opening.

2. A built-in sink unit according to claim 1, wherein the waste disposal opening is provided with a collar which protrudes downwardly into the drop shaft and whose external cross-section is adapted to the internal cross-section of the drop shaft so that the collar fits into the drop shaft.

3. A built-in sink unit according to claim 1, wherein an upper end of the drop shaft rests from below against the built-in sink.

4. A built-in sink unit according to claim 1, wherein a protective shaft which may be lifted out of the sink in an upward direction is insertable into the drop shaft.

5. A built-in sink unit according to claim 4, wherein the protective shaft is provided with an upper flange for being placed onto an attachment edge which circumscribes the waste disposal opening.

6. A built-in sink unit according to claim 2, wherein the attachment edge circumscribes the collar which is arranged between the drop shaft and the protective shaft.

7. A built-in sink unit according to claim 4, wherein a sealing member is provided between an upper end of the protective shaft and the sink.

8. A built-in sink unit according to claim 7, wherein the flange of the protective shaft is provided with a sealing member for resting against the attachment edge.

9. A built-in sink unit according to claim 1, wherein a removable cover for closing the waste disposal opening is provided.

10. A built-in sink unit according to claim 4, wherein a sealing member cooperating with the cover is provided at the upper end of the protective shaft.

11. A built-in sink unit according to claim 4, wherein, when the protective shaft is inserted into the sink, its lower edge is flush with that of the drop shaft.

12. A built-in sink unit according to claim 1, wherein said holding means have guide rails extending transversely to the longitudinal direction of the sink and at least approximately horizontally, said waste container having the shape of a bin with lateral support members insertable into said guide rails, and wherein an upper opening of the bin held beneath the lower end of the drop shaft is larger than the cross-section of the drop shaft.

13. A built-in sink unit according to claim 12, wherein the drop shaft is located above the front bin area when the bin is in its inserted end position.

14. A built-in sink unit according to claim 12, wherein the bin has a rear area of its upper opening which, when the bin is in its inserted end position, protrudes rearwardly beyond the drop shaft and is covered by a closure plate.

15. A built-in sink unit according to claim 14, wherein the closure plate is rigidly connected to said holding means.

16. A built-in sink unit according to claim 1, wherein said holding means comprise a supporting device attached to the sink.

17. A built-in sink unit according to claim 16, wherein the supporting device is attached close to the front and rear edge of the built-in sink on its underside.

18. A built-in sink unit according to claim 16, wherein the drop shaft is held and made to rest against the underside of the sink by the supporting device.

19. A built-in sink unit according to claim 18, wherein the drop shaft is a component of the supporting device.

20. A built-in sink unit according to claim 12, wherein the guide rails are formed on the closure plate.

21. A built-in sink unit according to claim 1, wherein the waste disposal opening is arranged immediately beside the sink basin, and wherein the distance between the side of the waste disposal opening facing away from the sink basin and the side of the sink basin facing away from the waste disposal opening corresponds approximately to the modular system width of a built-in kitchen and preferably to 60 cm.

22. A built-in sink unit according to claim 12, wherein, when viewed from above, the bin is approximately rectangular and the length of its narrow side corresponds approximately to the width of the waste disposal opening.

23. A built-in sink unit according to claim 22, wherein there are provided beside the sink basin, behind one another, the waste disposal opening and a trough provided with an outlet opening, and wherein the upper opening of the bin corresponds in size and shape approximately to the area of the built-in sink defined by the waste disposal opening and the trough.

24. A built-in sink unit according to claim 14, wherein the closure plate is located at a distance above the upper edge of the bin.

25. A built-in sink unit according to claim 14, wherein the closure plate has an opening corresponding to the cross-section of the drop shaft and is attached to the drop shaft.

26. A built-in sink unit according to claim 14, wherein a front edge area of the closure plate extends upwardly at an incline.

27. A built-in sink unit according to claim 12, wherein the bin comprises on each of its two sides at the top one transversely protruding supporting web for insertion into one of the guide rails.

28. A built-in sink unit according to claim 27, wherein the bin comprises a bearing bracket which is hinged on both of its sides and rests in its rest position on the supporting webs.

29. A built-in sink unit according to claim 5, wherein the attachment edge circumstances the collar which is arranged between the drop shaft and the protective shaft.

30. A built-in sink unit according to claim 9, wherein a sealing member cooperating with the cover is provided at the upper end of the protective shaft.

31. A built-in sink unit according to claim 14, wherein the guide rails are formed on the closure plate.

32. A built-in sink unit according to claim 17, wherein the drop shaft is held and made to rest against the underside of the sink by the supporting device.

* * * * *